US009538859B1

(12) United States Patent
Johnson et al.

(10) Patent No.: US 9,538,859 B1
(45) Date of Patent: Jan. 10, 2017

(54) SHELF UNIT FOR A RETAIL STORE DISPLAY FIXTURE

(71) Applicant: Target Brands, Inc., Minneapolis, MN (US)

(72) Inventors: Jason W. Johnson, Wayzata, MN (US); Erin L. Zobel, Minneapolis, MN (US); Enzo Vardaro, Montreal, CA (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/870,576

(22) Filed: Sep. 30, 2015

(51) Int. Cl.
*A47F 5/00* (2006.01)
*A47B 96/02* (2006.01)
*A47F 3/00* (2006.01)

(52) U.S. Cl.
CPC ..... *A47F 5/0043* (2013.01); *A47B 96/021* (2013.01); *A47F 3/001* (2013.01); *A47F 5/0018* (2013.01)

(58) Field of Classification Search
CPC ... A47B 2220/0077; A47B 3/001; A47B 3/00; A47B 5/0043; A47B 5/10; A47F 5/0043; A47F 5/0018; A47F 3/001
USPC ..... 108/106–108, 23, 147.11, 147.17, 157.1, 108/157.16, 158; 211/175, 150, 135, 187, 211/153, 193, 207, 90.02, 90.04; 362/133, 362/127, 125, 126
See application file for complete search history.

(56) References Cited

U.S. PATENT DOCUMENTS 1,971,744 A 8/1934 Brykczynski et al.
D164,767 S 10/1951 Fleming
2,781,918 A 2/1957 Palm, Jr.
3,845,864 A * 11/1974 Heinrich ..... A47B 96/021 211/153
3,919,950 A 11/1975 Frazelle et al.
4,139,247 A * 2/1979 Karashima ..... A47B 96/027 108/137
D265,273 S 7/1982 Leo, Jr.
D272,110 S 1/1984 Taub
D272,264 S 1/1984 Voltz
D279,638 S 7/1985 Kellogg
5,074,422 A * 12/1991 Holtz ..... A47B 57/10 108/108
D323,766 S 2/1992 Robbins et al.
5,218,914 A 6/1993 Dickinson
5,322,174 A * 6/1994 Wolters ..... A47B 96/18 211/153
5,573,322 A * 11/1996 Wrobel ..... A47B 96/021 108/27
5,626,084 A * 5/1997 Kelly ..... A47B 96/02 108/23
D381,362 S 7/1997 Meyer
5,673,801 A * 10/1997 Markson ..... A47F 5/005 211/184

(Continued)

OTHER PUBLICATIONS

U.S. Appl. No. 14/599,683, filed Jan. 19, 2015, 22 pages .
U.S. Appl. No. 29/514,946, filed Jan. 19, 2015, 4 pages.

*Primary Examiner* — Janet M Wilkens
(74) *Attorney, Agent, or Firm* — Leanne Taveggia Farrell; Westman, Champlin & Koehler, P.A.

(57) ABSTRACT

A shelf unit includes a base frame having first and second shelf brackets, lengthwise supports extending from the first shelf bracket to the second shelf bracket and widthwise strips extending between the lengthwise supports. A plurality of shelf skins are spaced apart from each other and mounted to the base frame. Each shelf skin surrounds at least a portion of a top, a bottom and a front of the base frame so that a portion of each widthwise strip of the base frame is exposed between the shelf skins.

19 Claims, 10 Drawing Sheets

(56) References Cited

U.S. PATENT DOCUMENTS 5,690,415 A 11/1997 Krehl
D393,171 S 4/1998 St-Pierre et al.
D394,180 S 5/1998 St-Pierre et al.
D394,365 S 5/1998 St-Pierre et al.
D394,774 S 6/1998 St-Pierre et al.
6,179,434 B1 * 1/2001 Saraiji ..... A47F 3/001 108/23
6,231,205 B1 * 5/2001 Slesinger ..... A47B 96/02 362/125
D614,428 S 4/2010 Bauchet et al.
7,739,964 B2 * 6/2010 Hatton ..... B63B 25/002 108/135
7,748,806 B2 * 7/2010 Egan ..... A47B 96/02 108/102
D621,193 S 8/2010 Bauchet et al.
7,832,570 B1 * 11/2010 Reynolds ..... A47B 57/56 211/103
8,215,795 B2 7/2012 Pichel
8,926,034 B2 * 1/2015 Park ..... A47B 96/025 108/102
2003/0205545 A1 * 11/2003 Moceri ..... A47B 61/02 211/90.02
2004/0182805 A1 * 9/2004 Harper ..... A47B 96/021 211/90.02
2006/0199495 A1 * 9/2006 Yamaguchi ..... A47F 3/001 454/173
2008/0198582 A1 * 8/2008 Cox ..... A47B 97/00 362/133
2009/0294392 A1 * 12/2009 Stafford ..... A47F 5/0025 211/153
2010/0232144 A1 * 9/2010 Gray ..... F21V 33/0012 362/133
2011/0174012 A1 * 7/2011 Park ..... A47B 96/027 62/449
2013/0343014 A1 * 12/2013 Browning ..... A47F 3/001 361/752
2015/0083028 A1 3/2015 Bedard et al.
2015/0243193 A1 8/2015 Trinh et al.
2015/0313359 A1 * 11/2015 Bennie ..... A47B 47/0066 211/135

* cited by examiner

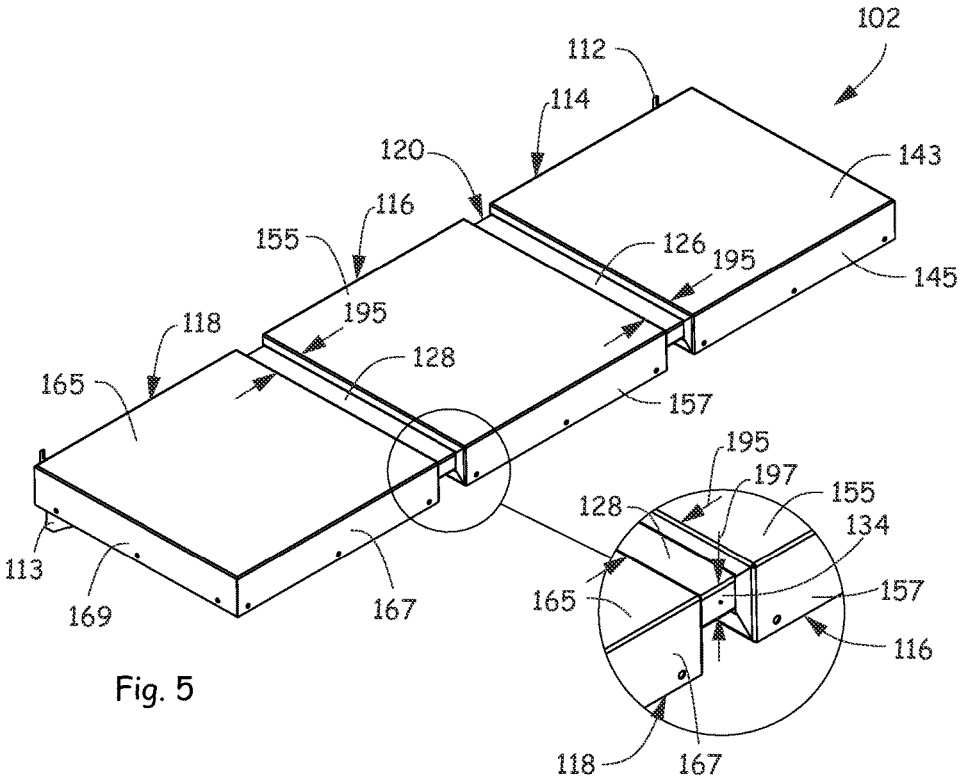
Fig. 5
Fig. 6
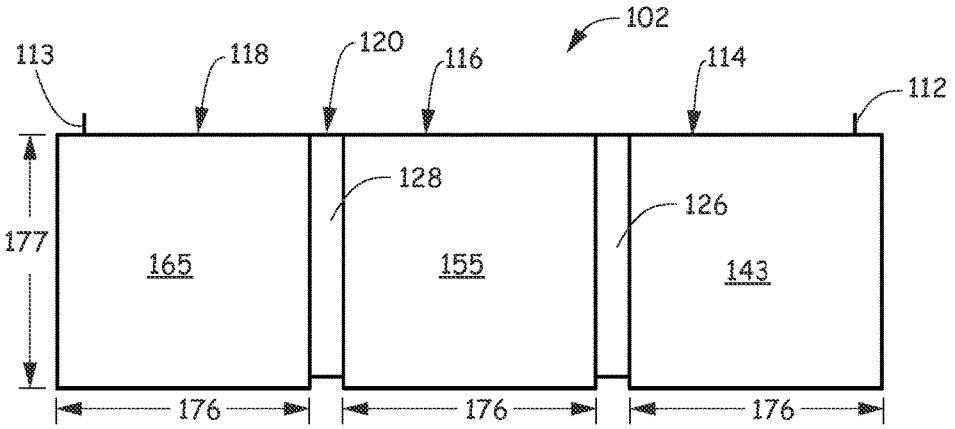
Fig. 7

SHELF UNIT FOR A RETAIL STORE DISPLAY FIXTURE

BACKGROUND

Retail stores use a variety of display fixtures to present products to customers for purchase. These display fixtures can support the product, indicate the product price and include signage and graphics for highlighting the product. Exemplary display structures include shelves, trays, racks, peg hooks and other similar structures.

The discussion above is merely provided for general background information and is not intended to be used as an aid in determining the scope of the claimed subject matter.

SUMMARY

A shelf unit includes a base frame and a plurality of shelf skins spaced apart from each other and mounted to the base frame. The base frame includes first and second shelf brackets, lengthwise supports extending from the first shelf bracket to the second shelf bracket and widthwise strips extending between the lengthwise supports. Each of the plurality of shelf skins surrounds at least a portion of a top, a bottom and a front of the base frame so that a portion of each widthwise strip of the base frame is exposed between the shelf skins.

A shelf unit mounts to uprights in a gondola display fixture and includes a plurality of display platforms wrapped around at least a portion of a top, a bottom and a front of a base frame mounted to the uprights of the gondola display fixture with first and second shelf brackets. The plurality of display platforms are spaced apart from each other, include top surfaces located a distance above the top of the base frame and are in alignment with each other. The plurality of display platforms further include bottom surfaces that are located a distance below the bottom of the base frame and that are in alignment with each other.

A shelf unit includes a base frame and a plurality of display platforms spaced apart from each other and wrapped around at least a portion of a top, a bottom and a front of the base frame. The base frame includes first and second shelf brackets, lengthwise supports extending from the first shelf bracket to the second shelf bracket and widthwise plates extending between the lengthwise supports. Exterior top surfaces and exterior bottom surfaces of each of the display platforms are in alignment with each other so that the display platforms appear to be multiple floating shelves mounted separately from each other, but are all mounted together using the first and second shelf brackets located on the base frame.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 5 is a perspective view of a shelf unit that when mounted to uprights on a gondola display fixture gives the appearance of three aligned floating shelves in accordance with one embodiment.

FIG. 6 is an enlarged view of a portion of FIG. 5.

FIG. 7 is a top view of FIG. 5.

DETAILED DESCRIPTION

Described below is a retail store display fixture that appears to include rows of three floating shelves when in fact each row of three floating shelves is a single shelf unit. The shelf unit includes a base frame with two brackets that are mounted to uprights of the display fixture, three shelf skins or display platforms that wrap around the base frame and are spaced apart from each other and three strips of downward oriented LED lights each housed in the underside of a respective shelf skin or display platform. The LED lights illuminate what is being displayed below the shelf unit. In this way, the display fixture gives the illusion of three floating shelves that are perfectly aligned in a row without the inconvenience and labor-intensive undertaking of actually mounting three floating shelves in alignment. In reality, the display fixture includes a single shelf unit that is easily attached to the uprights on the back wall by two brackets.

Figure 1:
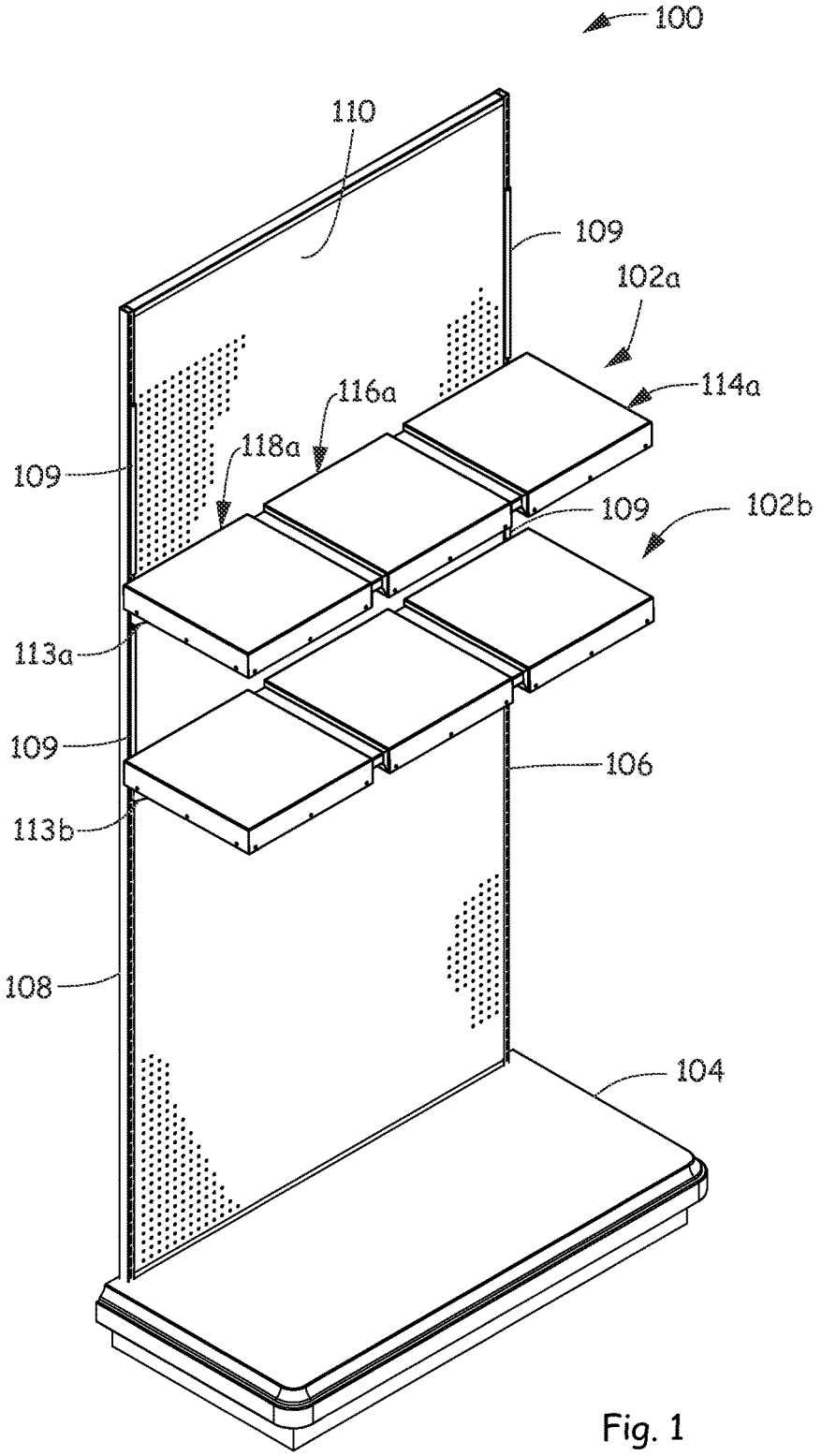
FIG. 1 is a perspective view of a gondola display fixture including two shelf units according to one embodiment.
Figure 2:
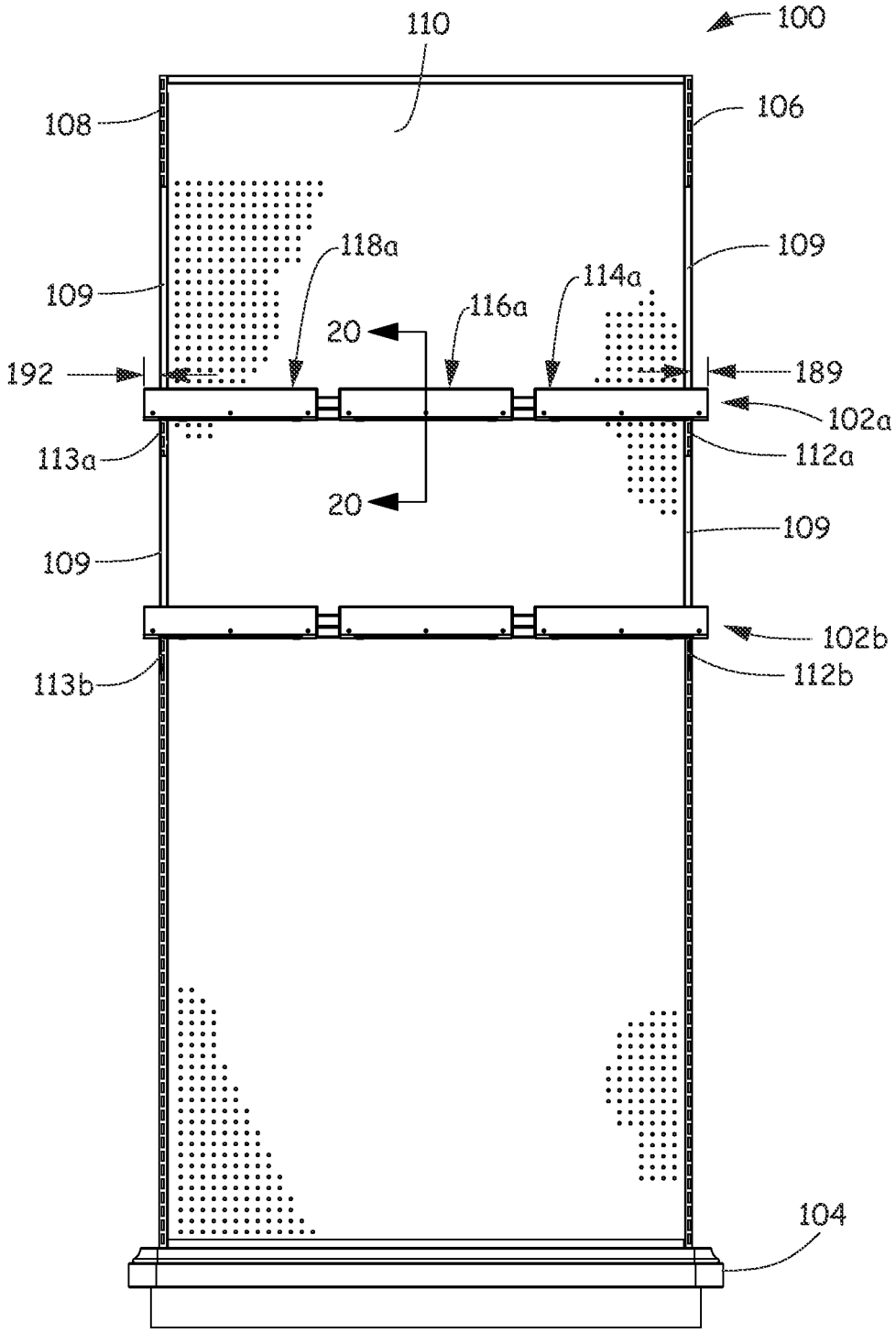
FIG. 2 is a front view of FIG. 1.
Figure 4:
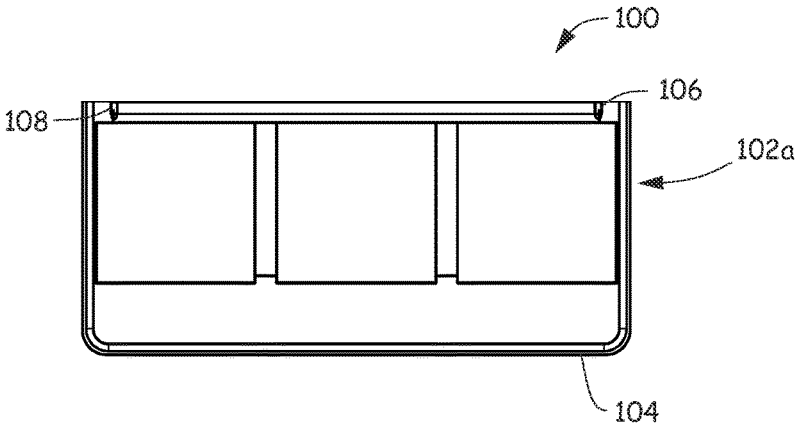
FIG. 4 is a top view of FIG. 1.
Figure 3:
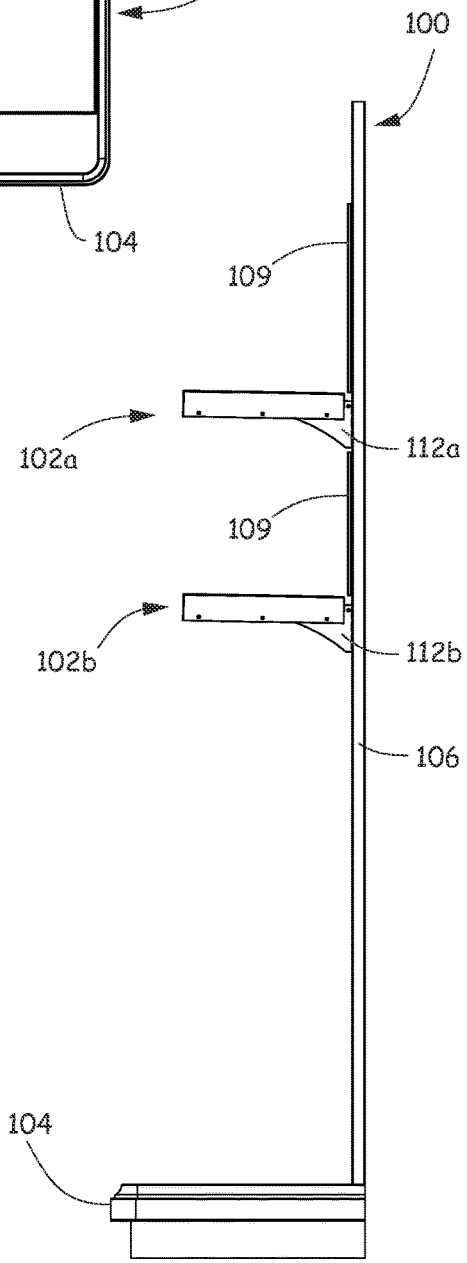
FIG. 3 is a right side view of FIG. 1.

FIG. 1 is a perspective view of a gondola display fixture 100. FIG. 2 is a front view, FIG. 3 is a right side view (the left side view being a minor image) and FIG. 4 is a top view of gondola display fixture 100. In one embodiment, gondola display fixture 100 is an endcap display fixture and is to be placed at an end of a row of gondola display units that define an aisle. Gondola display fixture 100 includes a base deck 104, a pair of uprights 106 and 108 and a back wall 110 located between pair of uprights 106 and 108. Attached to gondola display fixture 100 and according to one embodiment are two shelf units 102*a* and 102*b*. Although gondola display fixture 100 includes two shelf units 102*a* and 102*b*, it should be realized that gondola display fixture 100 can include any number of shelf units 102*a* and 102*b* including only one shelf unit. Shelf unit 102*a* is mounted to uprights 106 and 108 of display fixture 100 with shelf brackets 112*a* and 113*a* and shelf unit 102*b* is mounted to uprights 106 and 108 of display fixture 100 below shelf unit 102*a* with shelf brackets 112*b* and 113*b*.

Figure 8:
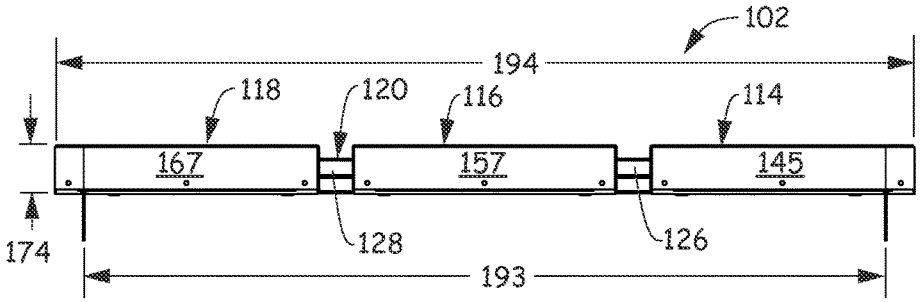
FIG. 8 is a front view of FIG. 5.
Figure 9:
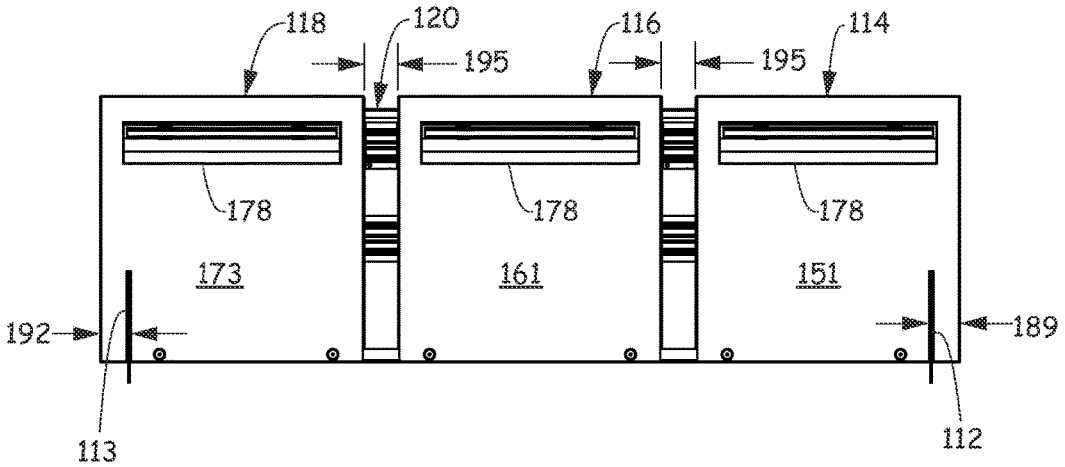
FIG. 9 is a bottom view of FIG. 5.
Figure 10:
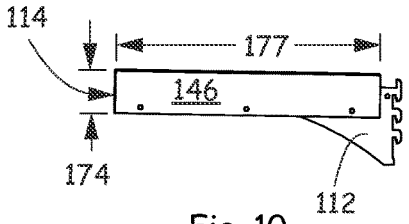
FIG. 10 is a right side view of FIG. 5.
Figure 11:
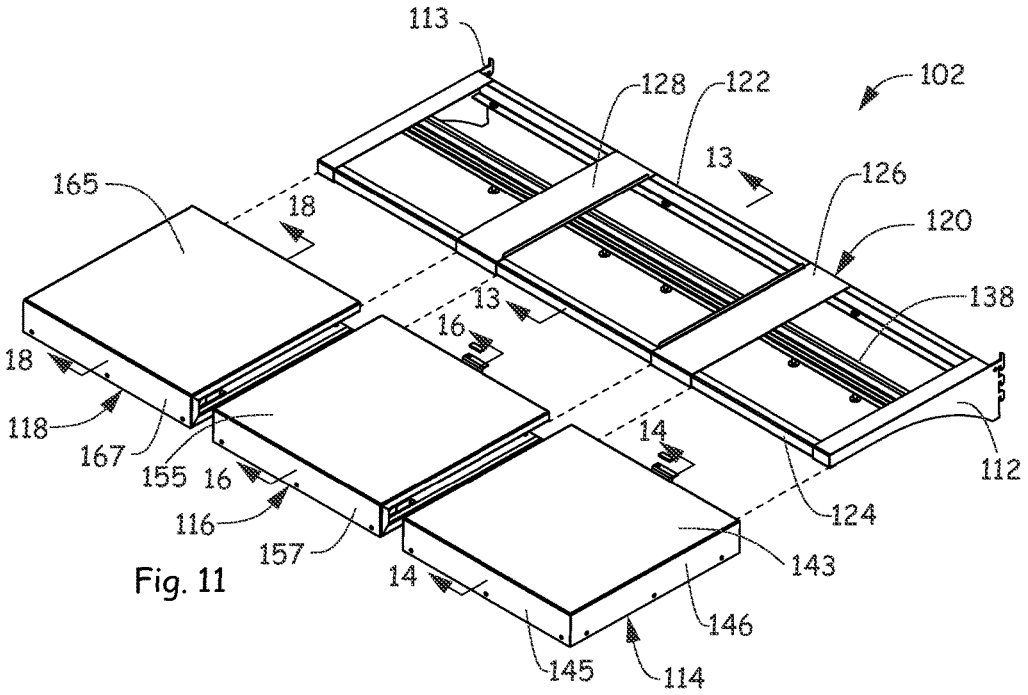
FIG. 11 is an exploded perspective view of the shelf unit of FIG. 5 including middle, right hand and left shelf skins exploded from a base frame according to one embodiment.

FIG. 5 illustrates a perspective of a shelf unit 102 that is representative of shelf units 102*a* and 102*b* and can be mounted to display fixture 100 according to one embodiment. FIG. 6 illustrates an enlarged perspective view of a portion of shelf unit 102, FIG. 7 is a top view of FIG. 5, FIG. 8 is a front view of FIG. 5, FIG. 9 is a bottom view of FIG. 5 and FIG. 10 is a right side view of FIG. 5 (the left side view being a mirror image). FIG. 11 is an exploded perspective view of shelf unit 102 of FIG. 5 including middle, right hand and left hand shelf skins or display platforms 114, 116 and 118 according to one embodiment.

Base frame 120 includes first shelf bracket 112 and second shelf bracket 113. Brackets 112 and 113 are knife brackets that include hooks for mounting to uprights 106 and 108. In particular, bracket 112 mounts to upright 106 and bracket 113 mounts to upright 108. Base frame 120 further includes a first lengthwise support or first cross support 122 and a second lengthwise support or second cross support 124. Supports 122 and 124 extend between first shelf bracket 112 and second shelf bracket 113. Base frame 120 further includes a first widthwise strip or plate 126 and a second widthwise strip or plate 128 that extend between lengthwise or cross supports 122 and 124.

Figure 12:
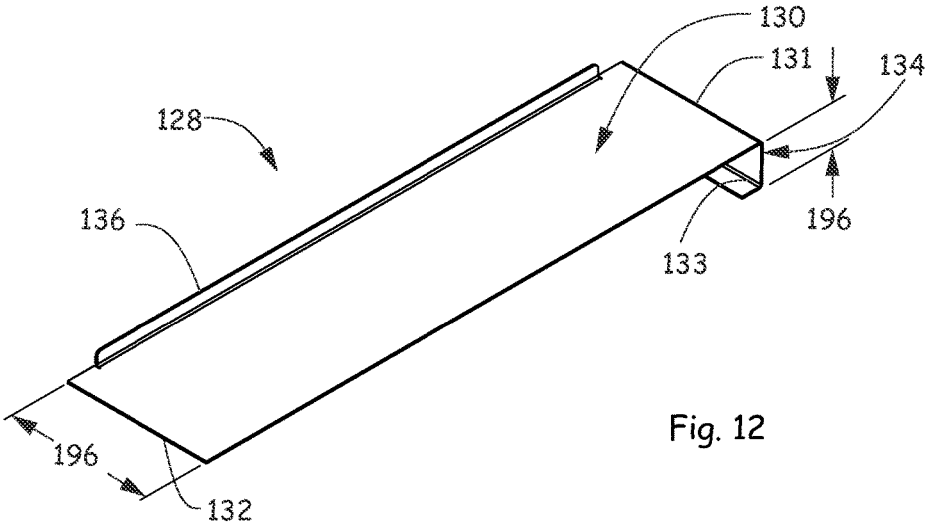
FIG. 12 is a perspective view of a widthwise strip or plate in FIG. 11 according to one embodiment.

FIG. 12 illustrates a perspective view of widthwise strip or plate 128 according to one embodiment. Strip or plate 128 includes a top planar region 130 having a first bend 131 and a back end 132 and a front region 134 that extends downwardly from top planar region 130 at front bend 131 and includes an additional bend 133. Strip or plate 128 further includes a flange 136 that extends from top planar region 130. Strip or plate 128 is substantially identical to strip or plate 126 except that flange 136 extends from top planar region 130 on the opposite side from the flange on strip or plate 126. Strips or plates 126 and 128 are coupled to lengthwise or cross supports 122 and 124 by, for example, welding.

Figure 13:
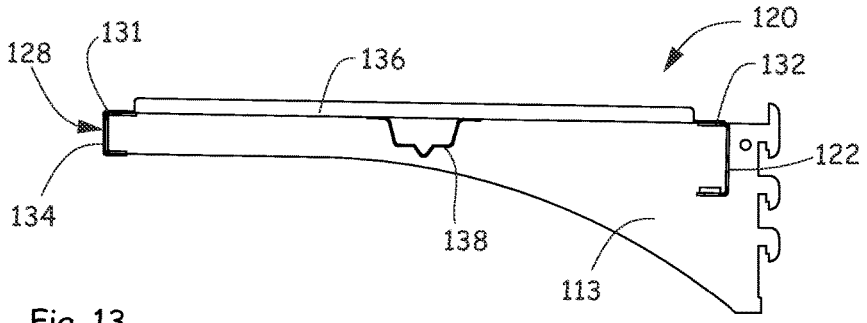
FIG. 13 is a section view of the base frame taken through the line 13-13 in FIG. 11.

FIG. 13 is a section view of base frame 120 taken through line 13-13 in FIG. 11. As illustrated, back end 132 of strip 128 (and also strip 126) are aligned with a side of first lengthwise support 122 that faces the back of shelf unit 102 and front region 134 of strip 128 (and also strip 126) wraps around the top, the side that faces the front of shelf unit 102 and the bottom of second lengthwise support 124. In particular, first bend 131 transitions front region 134 of strip 128 from the top of second lengthwise support 124 to the side of second lengthwise support 124 that faces the front of shelf unit 102. Second bend 133 transitions front region 134 of strip 128 from the side of second lengthwise support 124 to the bottom of second lengthwise support 124. Still further, base frame 129 includes a hat channel 138. Hat channel 138 manages power cords needed to power the light fixtures located on the underside of each shelf skin 114, 116 and 118. The light fixtures will be discussed in detail below.

Shelf skins or display platforms 114, 116 and 118 are spaced apart from each other along the lengths of lengthwise supports 122 and 124 and are mounted to base frame 120 such that each shelf skin or display platform 114, 116 and 118 surrounds at least a portion of a top, a bottom and a front of base frame 120. The plurality of shelf skins or display platforms include right hand shelf skin or display platform 114, middle shelf skin or display platform 116 and left hand shelf skin or display platform 118.

Figure 14:
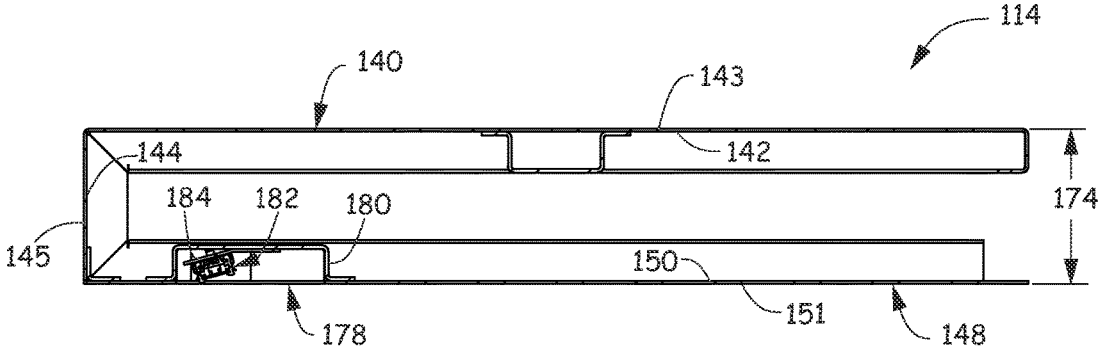
FIG. 14 is a section view of the right hand shelf skin taken through the line 14-14 in FIG. 11.
Figure 15:
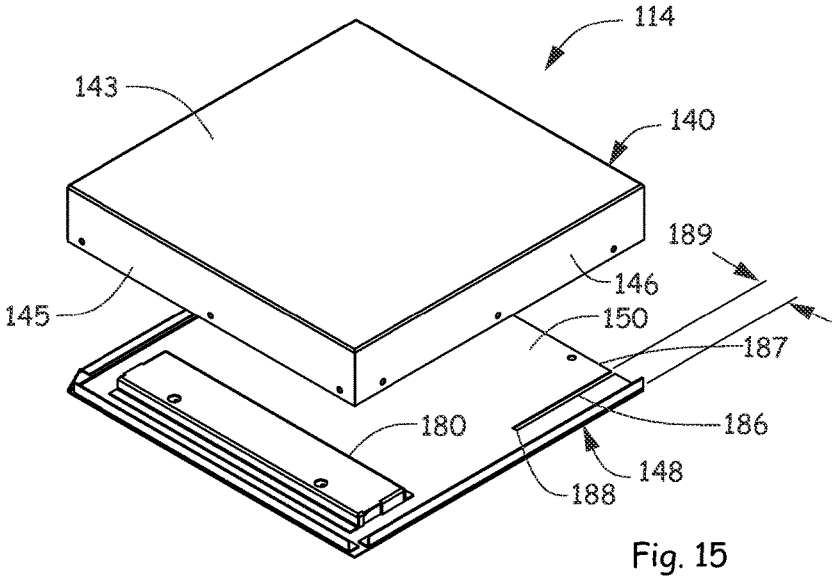
FIG. 15 is an exploded view of the right hand shelf skin in FIG. 11.

With reference to FIGS. 5-11, FIG. 14, which is a section view of right hand shelf skin 114 taken through the section line 14-14 in FIG. 11 and FIG. 15, which is an exploded view of right hand shelf skin 114, right hand shelf skin 114 includes a top member 140 having interior and exterior top surfaces 142 and 143, interior and exterior front surfaces 144 and 145 and an interior right side surface (not shown) and an exterior right side surface 146. Right hand shelf skin 114 further includes a bottom member 148 having interior and exterior bottom surfaces 150 and 151.

Figure 16:
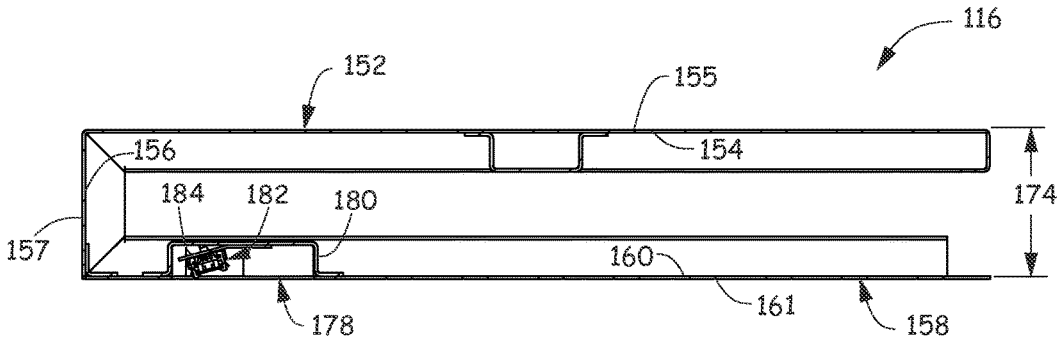
FIG. 16 is a section view of the middle shelf skin taken through the line 16-16 in FIG. 11.
Figure 17:
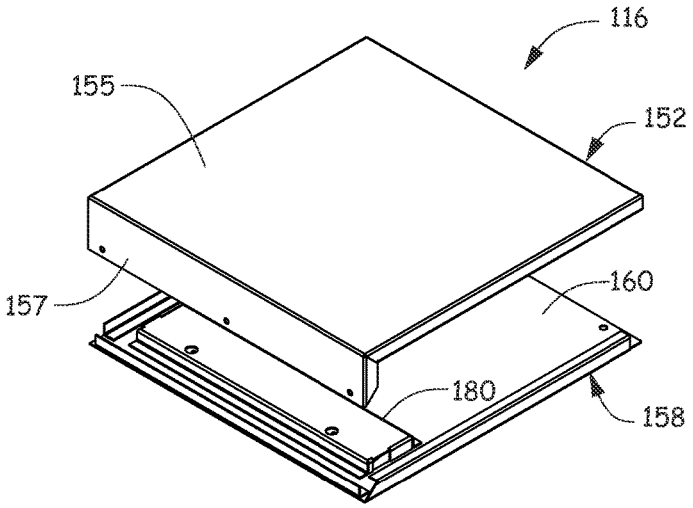
FIG. 17 is an exploded view of the middle shelf skin in FIG. 11.

With reference to FIGS. 5-11, FIG. 16, which is a section view of middle shelf skin 116 taken through the section line 16-16 in FIG. 11 and FIG. 17, which is an exploded view of middle shelf skin 116, middle shelf skin 116 includes a top member 152 having interior and exterior top surfaces 154 and 155 and interior and exterior front surfaces 156 and 157. Middle shelf skin 116 further includes a bottom member 158 having interior and exterior bottom surfaces 160 and 161.

Figure 18:
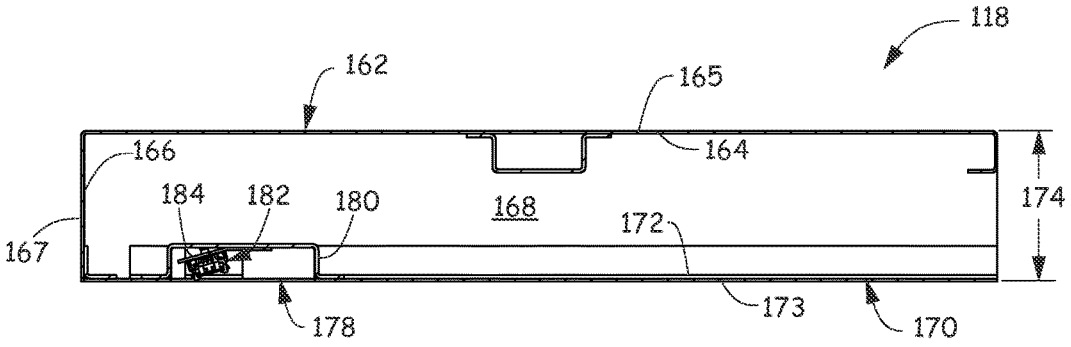
FIG. 18 is a section view of the left hand shelf skin taken through the line 18-18 in FIG. 11.
Figure 19:
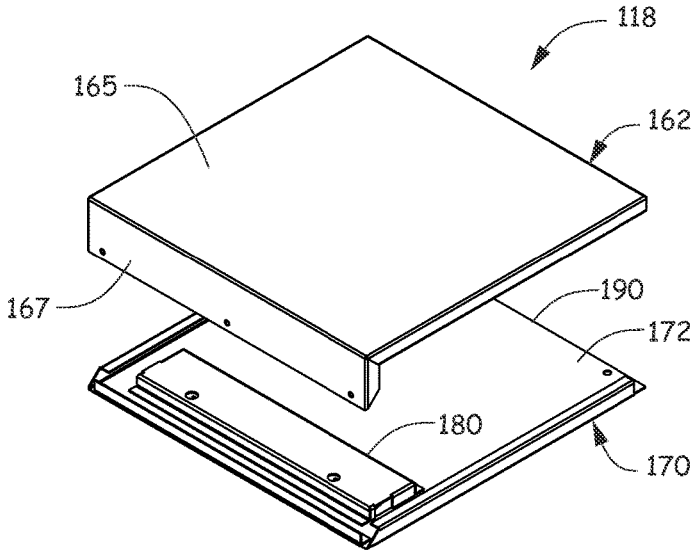
FIG. 19 is an exploded view of the left hand shelf skin in FIG. 11.

With reference to FIGS. 5-11, FIG. 18, which is a section view of left hand shelf skin 118 taken through the section line 18-18 in FIG. 11 and FIG. 19, which is an exploded view of left hand shelf skin 118, left hand shelf skin 118 includes a top member 162 having interior and exterior top surface 164 and 165, interior and exterior front surfaces 166 and 167 and an interior left side surface 168 and an exterior left side surface 169. Left hand shelf skin 118 further includes a bottom member 170 having interior and exterior bottom surfaces 172 and 173.

As illustrated in FIGS. 14, 16 and 18, each shelf skin 114, 116 and 118 includes exterior top surface 143, 155 and 165 being spaced apart from exterior bottom surface 151, 161 and 173, respectively, by the same height 174. In fact, all of the outer dimensions of shelf skin 114, 116 and 118 are substantially the same including substantially the same length 176 and substantially the same depth or width 177 as illustrated in FIGS. 7, 8 and 10. In addition, the exterior top surfaces 143, 155 and 165 of each shelf skin 114, 116 and 118 are in alignment with each other such that they are in the same plane and the exterior bottom surfaces 151, 161 and 173 are in alignment with each other such that they are in the same plane. The alignment of these surfaces of shelf skins 114, 116 and 118 on shelf unit 102 are important in giving the illusion of three floating shelves that are perfectly aligned in a row.

Also important to giving the illusion of three floating shelves are the dimensions of each shelf skin 114, 116 and 118 relative to the dimensions of widthwise strips or plates 126 and 128 as mounted to base frame 120. As illustrated in FIGS. 5, 6 and 9, each shelf skin 114, 116 and 118 is spaced apart from each other by a distance 195. Distance 195 is less than a width 196 (FIG. 12) of each widthwise strip or plate 126 and 128. Therefore, only a portion of the width 196 of each widthwise strip 126 and 128 is exposed between shelf skins or display platforms 114, 116 and 118 as illustrated in FIGS. 5, 6, 7 and 8. In addition, the portion of each front region 134 of each widthwise strip or plate 126 and 128 that is defined between first bend 131 and second bend 133 has a thickness 197 (FIG. 6). Thickness 197 is less than or thinner than height 174 of each shelf skin 114, 116 and 118. Still further, each shelf skin 114, 116 and 118 is painted with a light color, such as white or off-white. Each widthwise strip or plate 126 and 128 is painted with a dark color, such as black or gray. So even though a portion of widthwise strip or plate 126 and 128 are exposed, the overall appearance of shelf unit 102 draws the eye to the light colored shelf skins or platforms 114, 116 and 118 and away from the dark colored widthwise strips or plates 126 and 128, which are camouflaged.

Each shelf skin 114, 116 and 118 includes an opening 178 (FIG. 9) that extends between the interior and exterior bottom surfaces 150 and 151, 160 and 161 and 172 and 173 of bottom members 148, 158 and 170. In addition, each shelf skin 114, 116 and 118 includes a channel 180 that covers opening 178 so that each channel 180 houses a light fixture 182 that includes a plurality of downward oriented lights. In fact, each channel 180 includes a tab 184 that is oriented at an angle relative to the interior and exterior bottom surface of each shelf skin to orient the lights downward and toward the back of shelf unit 102.

With reference back to FIGS. 5 and 7-10 where shelf skins 114, 116 and 118 are assembled to base frame 120, right hand shelf skin 114 and left hand shelf skin 116 cover a portion of first shelf bracket 112 and a portion of second shelf bracket 113, respectively, so as to hide the shelf brackets from view. In particular and as illustrated in FIG. 15, bottom member 148 of right hand shelf skin 114 includes an elongated slot 186 that extends from a back 187 of bottom member 148 to an end point 188. Elongated slot 186 is positioned a distance 189 from a right side of bottom member 148 and receives first shelf bracket 112. Distance 189 is also shown in FIG. 9 and in FIG. 2 as a distance that the right side of right hand shelf skin 114 extends away from upright 106.

Still further, bottom member 170 of left hand shelf skin 118 includes in an elongated slot that although not illustrated in FIG. 19 is in a mirrored positioned on bottom member 170 from bottom member 148. The elongated slot in bottom member 170 extends from a back 190 of bottom member 148 to an end point. The elongated slot in bottom member 170 is positioned a distance 192 from a left side of bottom member 170 and receives second shelf bracket 113. Distance 192 is shown in FIG. 9 and in FIG. 2 as a distance that the left side of left hand shelf skin 118 extends away from upright 108. It should be realized that distance 189 of elongated slot 186 in bottom member 148 is substantially the same as distance 192 of the elongated slot in bottom member 170. Therefore and as illustrated in FIG. 8, a length 193 of base frame 120 is less than a length 194 of the shelf skins 114, 116 and 118 wrapped around base frame 120.

Figure 20:
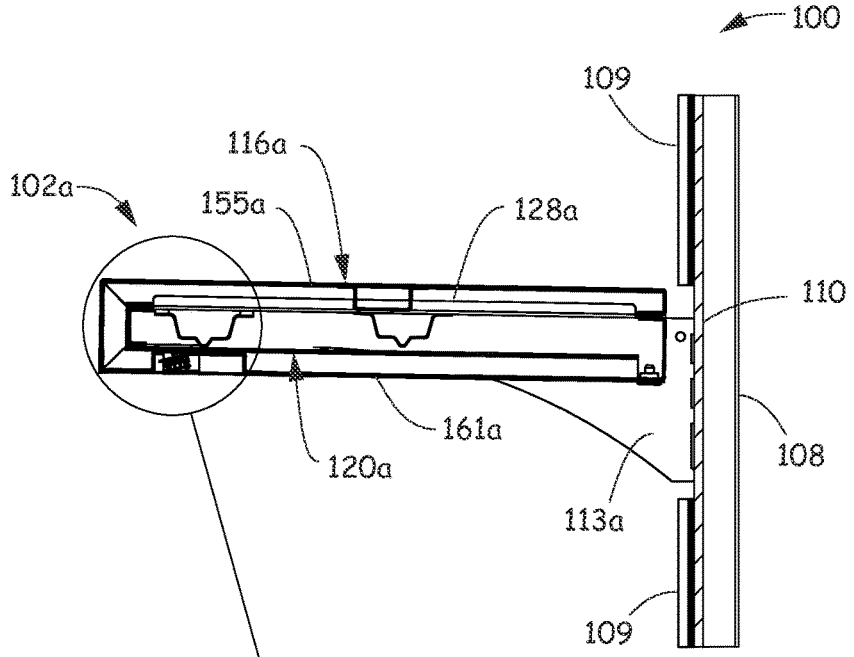
FIG. 20 is a section view of the display fixture illustrated in FIGS. 1-4 taken through the line 20-20 in FIG. 2.

FIG. 20 is a section view of shelf unit 102*a* mounted to uprights 106 and 108 of gondola display fixture 100 with shelf brackets 112*a* and 113*a* and taken through line 20-20 in FIG. 2. FIG. 20 illustrates middle shelf skin 116*a* wrapped around base frame 120*a*, which includes widthwise strip or plate 128*a*. As illustrated, shelf bracket 113*a* is mounted to upright 108. Located along upright 108 and also upright 106 in FIGS. 1-3 is a cord channel 109 for the further management of power cords located in hat channels in shelf unit 102*a* and their transition from shelf unit 102*a* to behind back wall 110.

Figure 21:
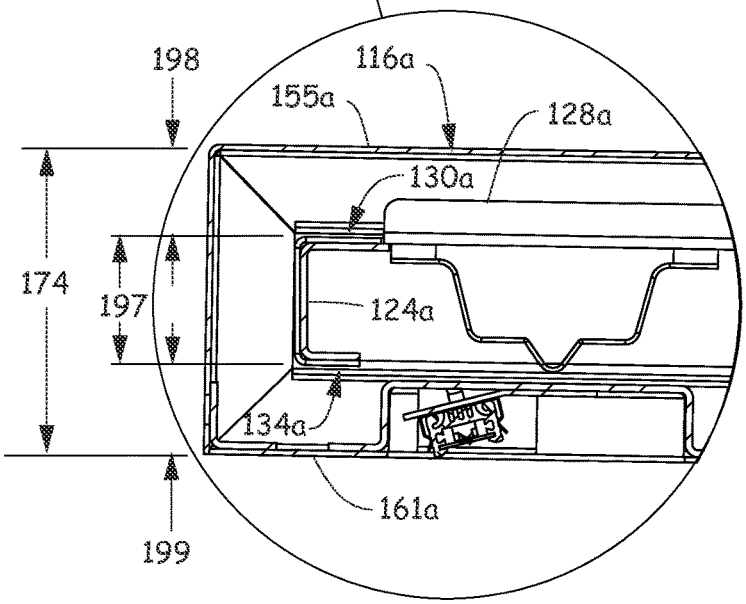
FIG. 21 is an enlarged view of a portion of FIG. 20.

FIG. 21 is an enlarged view of the front end of shelf unit 102*a* of FIG. 20. As illustrated, exterior top surface 155*a* of shelf skin 116*a* is located a distance 198 above top planar region 130*a* of widthwise strip or plate 128*a*, which is the top of base frame 120*a*. Also, exterior bottom surface 161*a* of shelf skin 116*a* is located a distance 199 below the portion of front region 134*a* of widthwise strip or plate 128*a* that is located below cross support 124*a*. This is the bottom of base frame 120. Distances 198 and 199 are the same for shelf skin 114*a* relative to base frame 120*a* and shelf skin 118*a* relative to base frame 120*a*. These relative distances add to the illusion of three floating shelves. Not only is thickness 197 of the base frame of each shelf unit thinner than height 174 of each shelf skin as discussed above, but the thickness 197 of the base frame of each shelf unit is positioned between exterior top surfaces 143, 155 and 156 and exterior bottom surfaces 151, 161 and 173 of each shelf skin 114, 116 and 118 to further camouflage or hide the portions of base frame 120 that are exposed.

In one embodiment, the three shelf skins, which are in alignment, each hold a consumer product for display. Each shelf skin can support the same consumer product, but in different colors or each shelf skin can support different consumer products of the same category. For example, each shelf skin can support an electrical mixer where each mixer is of a different color. Below shelf units 102*a* and 102*b* is space for storing boxes or stock of consumer products that are on display above for purchase. For example, boxes of mixers can be stocked below shelf unit 102*a* and 102 in the variety of different colors.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A shelf unit comprising:

a base frame including first and second shelf brackets, lengthwise supports extending from the first shelf bracket to the second shelf bracket and widthwise strips extending between the lengthwise supports; and a plurality of shelf skins spaced apart from each other and mounted to the base frame, each shelf skin surrounding at least a portion of a top, a bottom and a front of the base frame so that a portion of each widthwise strip of the base frame is exposed between the shelf skins.

2. The shelf unit of claim 1, wherein the plurality of shelf skins comprise a right hand shelf skin, a middle shelf skin and a left hand shelf skin.

3. The shelf unit of claim 2, wherein each shelf skin comprises a top member having an exterior top surface and a bottom member an exterior bottom surface, wherein the exterior top surface of the top member is spaced apart from the exterior bottom surface of the bottom member by substantially a same distance in each shelf skin.

4. The shelf unit of claim 3, wherein the top member of the right hand shelf skin further comprises an exterior right side surface.

5. The shelf unit of claim 3, wherein top member of the left hand shelf skin further comprises an exterior left side surface.

6. The shelf unit of claim 3, wherein the bottom member of each shelf skin further comprises an opening that extends between an interior bottom surface of the bottom member and exterior bottom surface and a channel that covers the opening so that each channel of the bottom member houses a light fixture that includes a plurality of downward oriented lights.

7. The shelf unit of claim 3, wherein the right hand shelf skin covers a portion of the first shelf bracket and the left hand shelf skin covers a portion of the second shelf bracket.

8. The shelf unit of claim 7, wherein the bottom member of the right hand shelf skin includes an elongated slot that extends from a back of the bottom member of the right hand shelf skin to an end point so as to receive the portion of the first shelf bracket.

9. The shelf unit of claim 7, wherein the bottom member of the left hand shelf skin includes an elongated slot that extends from a back of the bottom member of the left hand shelf skin to an end point so as to receive the portion of the second shelf bracket.

10. The shelf unit of claim 3, wherein the exterior top surfaces of each top member of each shelf skin are in alignment with each other and the exterior bottom surfaces of each bottom member of each shelf skin are in alignment with each other.

11. A shelf unit that mounts to uprights in a gondola display fixture, the shelf unit comprising:

a plurality of display platforms wrapped around at least a portion of a top, a bottom and a front of a base frame mounted to the uprights of the gondola display fixture with first and second shelf brackets, the plurality of display platforms being spaced apart from each other;

wherein the plurality of display platforms include top surfaces located a distance above the top of the base frame, the top surfaces being in alignment with each other;

wherein the plurality of display platforms include bottom surfaces located a distance below the bottom of the base frame, the bottom surfaces being in alignment with each other; and wherein each display platform includes a channel that couples to bottom members of each display platform and houses a light fixture that includes a plurality of downward oriented lights.

12. The shelf unit of claim 11, wherein the base frame comprises a plurality of cross supports that run lengthwise from the first shelf bracket to the second shelf bracket and a plurality of plates that run widthwise between the plurality of cross supports.

13. The shelf unit of claim 12, wherein at least a portion of the plurality of plates are exposed between the plurality of display platforms.

14. The shelf unit of claim 11, wherein the plurality of display platforms comprise a right hand display platform, a middle display platform and a left hand display platform.

15. The shelf unit of claim 14, wherein the right hand display platform covers a portion of the first shelf bracket and the left hand display platform covers a portion and the second shelf bracket.

16. The shelf unit of claim 14, wherein bottom surfaces of the right hand display platform and the left hand display platform include elongated slots that extend from a back of each bottom surface to an end point so that the right hand display platform receives the portion of the first shelf bracket and the left hand display platform receives the portion of the second shelf bracket.

17. A shelf unit comprising:

a base frame including first and second shelf brackets, lengthwise supports extending from the first shelf bracket to the second shelf bracket and widthwise plates extending between the lengthwise supports; and a plurality of display platforms spaced apart from each other and wrapped around at least a portion of a top, a bottom and a front of the base frame, wherein exterior top surfaces and exterior bottom surfaces of each of the display platforms are in alignment with each other so that the display platforms appear to be multiple floating shelves mounted separately from each other, but are all mounted together using the first and second shelf brackets located on the base frame.

18. The shelf unit of claim 17, wherein each display platform comprises a height that is greater than a thickness of the base frame.

19. The shelf unit of claim 18, wherein each display platform comprises a bottom member having an opening that extends between an interior bottom surface of the bottom member and an exterior bottom surface of the bottom member and a channel that covers the opening in the bottom member so that each channel houses a light fixture that includes a plurality of downward oriented lights.

* * * * *